US007287985B2

(12) United States Patent
Bütler

(10) Patent No.: US 7,287,985 B2
(45) Date of Patent: Oct. 30, 2007

(54) BRUSH BLOCK FOR TRANSMITTING CURRENTS

(75) Inventor: Olaf Bütler, Sulzbach (DE)

(73) Assignee: Walter Kraus GmbH (DE)

( * ) Notice: Subject to any disclaimer, the term of this patent is extended or adjusted under 35 U.S.C. 154(b) by 0 days.

(21) Appl. No.: 10/567,818

(22) PCT Filed: Aug. 6, 2004

(86) PCT No.: PCT/EP2004/008838

§ 371 (c)(1),
(2), (4) Date: Feb. 8, 2006

(87) PCT Pub. No.: WO2005/020391

PCT Pub. Date: Mar. 3, 2005

(65) Prior Publication Data

US 2006/0286821 A1 Dec. 21, 2006

(30) Foreign Application Priority Data

Aug. 13, 2003 (DE) ..... 203 12 458 U

(51) Int. Cl.
*H01R 39/00* (2006.01)

(52) U.S. Cl. ..... 439/13

(58) Field of Classification Search ..... 439/26, 439/13, 22, 23; 310/242, 248, 232; 399/90, 399/73; 204/279

See application file for complete search history.

(56) References Cited

U.S. PATENT DOCUMENTS

| | | | | |
|---|---|---|---|---|
| 4,167,685 A | | 9/1979 | Bates | |
| 4,337,407 A | | 6/1982 | Hummert | |
| 4,358,699 A | * | 11/1982 | Wilsdorf | 310/251 |
| 5,049,771 A | * | 9/1991 | Challita et al. | 310/219 |
| 5,712,522 A | | 1/1998 | Niimi | |
| 6,071,125 A | * | 6/2000 | Shiozawa | 439/26 |

FOREIGN PATENT DOCUMENTS

| | | |
|---|---|---|
| DE | 19 13 246 | 9/2000 |
| DE | 201 15 215 | 12/2001 |
| DE | 101 34 277 | 1/2003 |
| GB | 1 499 808 | 2/1978 |
| WO | WO 03/055043 | 7/2003 |

* cited by examiner

*Primary Examiner*—Alexander Gilman
(74) *Attorney, Agent, or Firm*—McGlew and Tuttle, P.C.

(57) ABSTRACT

A brush block is provided for transmitting currents to a slip ring using at least one multi-wire slip element with a plurality of parallel connected multi-wire slip elements that are distributed one behind the other in the direction of slip following an imaginary curve. The brush block has a multi-wire slip element support with a curved inner wall on which the multi-wire slip elements are disposed in layers that overlap in scale-like fashion.

13 Claims, 2 Drawing Sheets

Fig. 1
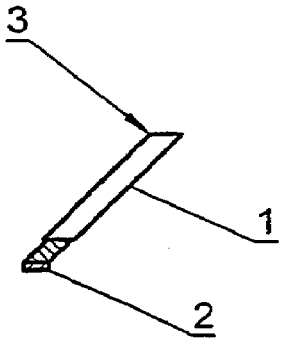
Fig. 2
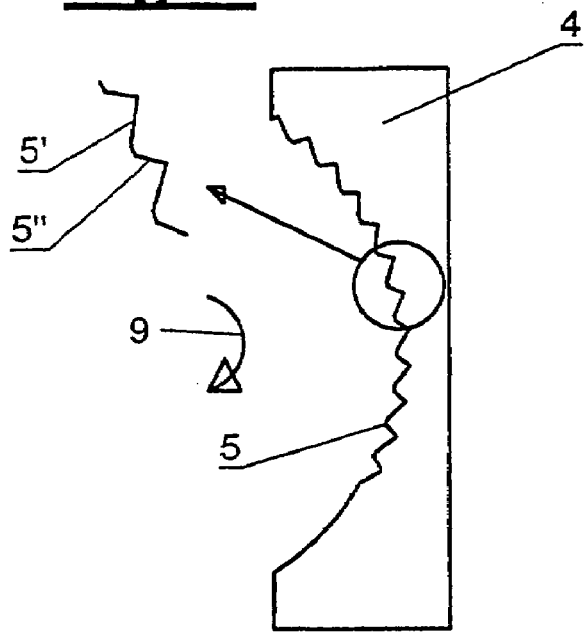
Fig. 3
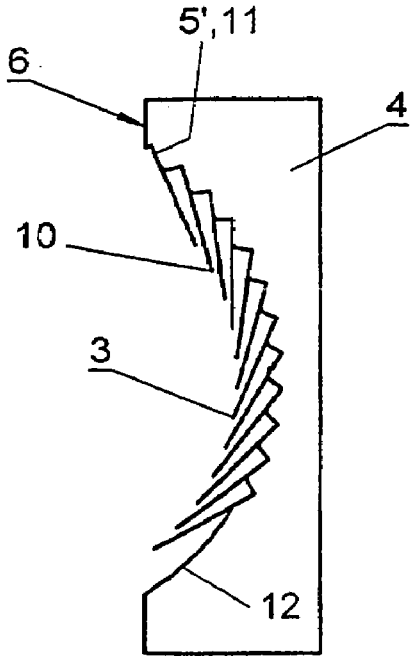
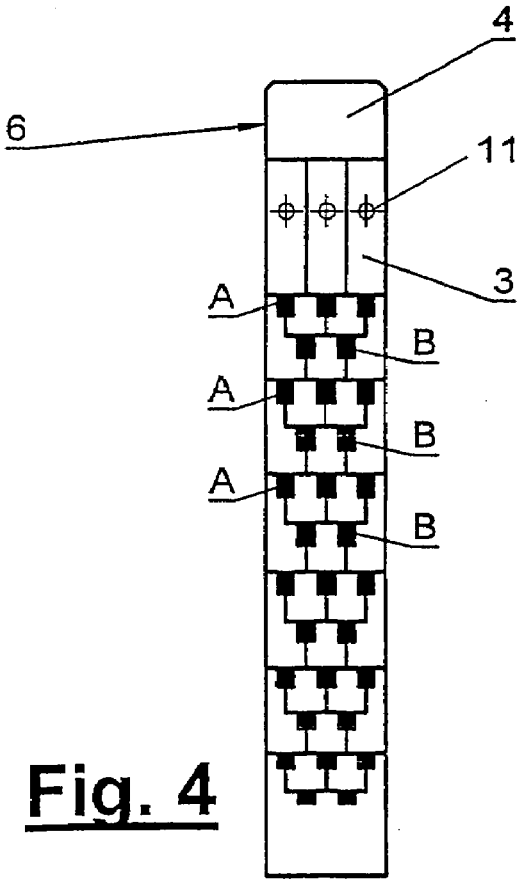
Fig. 4

BRUSH BLOCK FOR TRANSMITTING CURRENTS

CROSS REFERENCE TO RELATED APPLICATIONS

This application is a United States National Phase application of International Application PCT/EP2004/008838 filed Aug. 6, 2004 and claims the benefit of priority under 35 U.S.C. § 119 of German Patent Application DE 203 12 458.8 filed Aug. 13, 2003, the entire contents of which are incorporated herein by reference.

FIELD OF THE INVENTION

The present invention pertains to a brush block for transmitting currents

BACKGROUND OF THE INVENTION

Devices for transmitting currents to a slip ring by means of a maximum of two sliding contacts have been known so far, which are suitable for transmitting signal currents with a current intensity in the mA range. These devices cannot transmit higher current intensities.

Since only a maximum of two sliding contacts are used to transmit the current, these devices imply a risk of failure, because the functionality of the entire device depends on a maximum of two individual elements subject to wear.

The sliding contacts, if they consist of multiwire slip rings, have hitherto been brought into contact with the slip ring mostly approximately vertically, which causes intense felting of the multiwire slip rings, a relatively large contact area and thus a high contact resistance.

SUMMARY OF THE INVENTION

The object of the present invention is to provide an improved device for transmitting currents.

According to the invention, a brush block is provided for transmitting currents to a slip ring by means of a plurality of multiwire sliding element (MWSE). The plurality of MWSE are connected electrically in parallel and are arranged at the brush block one after another and distributed in an arc in a direction of sliding.

According to another aspect of the invention, a rotating current transmission unit is provided with one or more slip rings and one or more brush blocks, which are mounted rotatably in relation to one another. The brush blocks are is provided for transmitting currents to a slip ring by means of a plurality of multiwire sliding element (MWSE). The plurality of MWSE are connected electrically in parallel and are arranged at the brush block one after another and distributed in an arc in a direction of sliding.

The device for transmitting currents comprises essentially at least one brush block, which is connected with a plurality of multiwire sliding elements (MWSE), wherein these MWSE can be brought tangentially into contact with a slip ring. The use of such a plurality of MWSE has the advantage that the current to be transmitted is distributed among a plurality of contacts connected in parallel. As a result, the current power to be transmitted per MWSE is greatly reduced, as a consequence of which wear due to heating is greatly reduced and it is, above all, possible to also transmit power currents with current intensities of 40 A or higher. Furthermore, sufficient contact is still present even in case of wear-related loss of contact of individual MWSE to guarantee sufficient transmission of the current. As a result, the service life of the device is prolonged and the risk of failure is reduced.

The individual brush block preferably comprises an MWSE carrier in conjunction with a plurality of MWSE. The MWSE carrier preferably has a plurality of regularly arranged stepped incisions on the inner side that points toward the slip ring and is essentially concentric with the slip ring. These stepped incisions are shaped such that one or more MWSE can be arranged on each of the sides of the step directed approximately tangentially to the slip ring. At right angles to the direction of rotation of the slip ring, a plurality of MWSE are arranged either directly adjoining one another or at slightly spaced locations next to one another on a step, and form an MWSE layer with one another.

The MWSE layers of two or more adjacent stepped incisions overlap one another in the form of scales. The MWSE thus arranged preferably describe with their free ends an enveloping curve, i.e., they approach a circular path, whose radius is somewhat smaller than the radius of the slip ring to be brought into contact. It is achieved as a result that the MWSE with the multiwire sliding rings can be brought into contact with the slip ring essentially tangentially and elastically and that the packing density of the sliding contacts is very high.

Furthermore, the MWSE are preferably arranged in the stepped incisions in such a structured form that the individual layers are each offset in relation to one another. The offset of the layers is such that the multiwire slip rings of one MWSE layer are arranged staggered in relation to the next MWSE layer. Two or more different layers of arrangement can now be formed.

The multiwire slip rings of two or more congruent, i.e., non-adjacent MWSE layers form a sliding track on the circumference of the slip ring. The MWSE layers are arranged at right angles to the direction of rotation of the slip ring, preferably such among one another that the sliding tracks of the respective offset MWSE layers adjoin each other as closely as possible and together form a broad overall track.

Due to this arrangement of the MWSE at the MWSE carrier, it is achieved that when the brush head is brought into contact, the contact area between the MWSE and the slip ring is substantially enlarged and is uniform in the circumferential direction, as a result of which uniform wear of the slip ring is brought about without groove formation and an essential enlargement of the contact area. This lowers the contact resistance, which in turn reduces the wear and prolongs the service life.

Each MWSE preferably comprises a flexible carrier leaf, at one end of which a multiwire slip ring is arranged. This multiwire slip ring comprises a plurality of small wires, which are integrated in one or more layers in the manner of a paintbrush. It is achieved as a result that the current to be transmitted is again distributed among many individual sliding wires. Every individual wire can adapt itself flexibly to small unevennesses of the slip ring, as a result of which a contact area of maximum size is covered. In addition, the multiwire slip rings are preferably bent off outwardly at their free ends in order to improve their stability and their guidance on the slip ring. Furthermore, the bending causes that the multiwire slip rings will not be upset or bent when the slip ring is possibly rotated in the opposite direction.

If one or more sliding wires drop off due to wear-related breakage of the material or for another reason, other, still fully or partially unworn wires may be arranged behind and next to these wires, which will come into contact with the slip ring instead of the wires that have fallen off. As a result, the service life of every individual MWSE is prolonged and a contact area of maximum size is always covered.

Due to the offset of the MWSE layers and the scale-like overlapping structure, the multiwire slip rings of the MWSE, which touch each other, will not come into direct contact even in case of an unforeseen deep penetration of the slip ring into the brush area, in which case individual MWSE would be pressed against each other, and the MWSE cannot become mutually entangled.

Even when individual wires of an MWSE drop off due to wear, these wires will not fall directly into a multiwire slip ring of the next MWSE layer, but they can fall out toward the outside through a free space due to the staggered positions of the individual MWSE layers.

All these wear reduction measures are responsible for a prolongation of the service life of the brush block, a reduction of the risk of failure and a reduced frequency of maintenance.

If the contact area is to be increased further, it is possible to arrange a plurality of brush blocks in such a way that they are arranged next to one another or one after another and distributed over the circumference of the slip ring. At least one third of the area of the slip ring is preferably covered by brush blocks.

Since a plurality of sliding contacts are integrated in one brush block, they can be mounted and replaced easily, as a result of which the arrangement shown can be installed and maintained at low cost.

Each brush block may cover either only part of the slip ring or the entire slip ring and accordingly have a full inner circle or a section of an arc of a circle, on which stepped sections with MWSE connected thereto are arranged.

Provisions are made in another imaginable embodiment of the present invention that the MWSE carrier and the slip ring are transposed with one another. In this case, the MWSE carrier is essentially round with stepped sections of the type shown on the outer circumference. The MWSE connected to the MWSE carrier correspondingly approach an outer circle with a slightly larger radius than the inner radius of the slip ring, which now lies on the outside.

In another embodiment of the present invention, the slip ring comprises two or more segments, which are insulated from one another and which are supplied with different currents via a plurality of differently poled brush blocks. It is achieved as a result that a plurality of currents can be transmitted on only one slip ring circumference in a space-saving manner in order to bring about, for example, pole reversals at regular intervals.

Furthermore, it is possible to vary geometrically the arrangement being shown such that the brush blocks are brought into contact with the front side rather than with the circumference of a slip ring. The slip ring carrier may have a plate-shaped design instead of a cylindrical design in this case. The design of the brush head correspondingly has a plurality of MWSE layers, which are arranged in the arc of the circle and describe circular sliding tracks on the front side of the slip ring. The individual layers are offset correspondingly similarly to the offset shown in case of circumferential brush blocks.

The present invention is schematically shown in the drawings as an example. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 1 is a diametric view of a multiwire sliding element;

FIG. 2 is a side view of an MWSE carrier;

FIG. 3 is a side view of a brush block;

FIG. 4 is a front view of a brush block;

DESCRIPTION OF THE PREFERRED EMBODIMENTS

Figure 5:
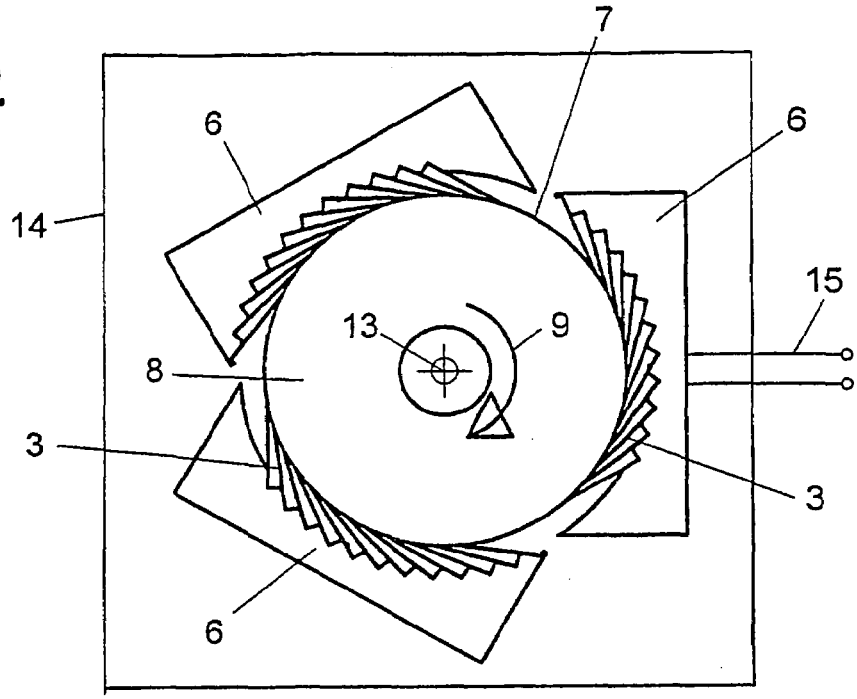
FIG. 5 is a side view of a current transmission means with three brush blocks in conjunction with a slip ring.

Referring to the drawings in particular, in a preferred embodiment of the present invention, the brush block generally designated 6 is used to transmit power currents to a slip ring 7, which is mounted on the circumferential side of a cylindrical carrier 8 rotating about the axis 13. The kinematic arrangement may also be reversed. The brush block 6, which is present as one brush block or as a plurality of brush blocks, and the one or more slip rings 7 arranged in parallel form a current transmission unit 14. FIG. 5 schematically shows a current transmission unit 14 with terminals 15 for power current, which are connected to the brush blocks 6. The slip ring or slip rings 7 has/have corresponding current connections.

The brush block 6 comprises a plurality of multiwire sliding elements 3 (hereinafter called MWSE), which are connected electrically in parallel and are arranged and fastened in a uniformly distributed pattern at an MWSE carrier 4 in the direction of sliding 9. A plurality of MWSE 3 are arranged here at mutually spaced locations from one another one after another in an arc in the direction of sliding 9 or in the circumferential direction of the slip ring 7. In this arrangement, the MWSE 3 together form with their ends a shell-like enveloping curve curved concentrically with the axis of rotation 13 of the slip ring 7 and a sliding mat 10, which is adapted to the contour of the slip ring. A plurality of contact points are thus obtained for current transmission.

As is shown in FIG. 1, each multiwire sliding element 3 comprises an electrically conductive, rigid or flexible carrier blade 1, which is mounted with one end at the MWSE carrier 4 at a suitable fastening point 11 and at the other end of which a multiwire slip ring 2 is arranged. The multiwire slip ring 2 comprises a plurality of flexible, thin sliding wires, which are located next to one another and optionally one on top of another in a one-layer or multilayer, paintbrush-like arrangement. The sliding wires are preferably bent off outwardly or bent at their free end.

The MWSE carrier 4 has an inner wall 12, which is bent concentrically with the axis 13 and at which a plurality of stepped incisions 5 are arranged in the embodiment according to FIG. 2. The stepped incisions 5 have a step side 5', which points toward the middle 13 and is directed approximately tangentially to the slip ring 7, and a step side 5" that is directed at right angles thereto [to the former step side] and is preferably perpendicular. A plurality of MWSE 3 are preferably arranged on each step side 5' next to one another with fastening points 11. The tangentially directed step sides 5' are spaced from one another by the step sides 5" directed at right angles to them. The stepped sections 5 follow the curvature of the slip ring and form a bent stepped contour with one another.

The MWSE 3 are directed essentially straight, and they lie with their carrier leaves, 1 flatly on the step side 5' and are directed tangentially to the slip ring 7. The MWSE 3 of one step form an MWSE layer A, B, the layers of a plurality of adjacent steps overlapping in a scale-like pattern. The layers A, B alternate regularly.

The tangential step side 5' is directed such that the free ends of the individual MWSE layers A, B describe the enveloping curve 10. The radius of this enveloping curve 10 is preferably somewhat smaller than the radius of the slip ring 7 that can be brought into contact. As a result, the elastic multiwire slip rings 2 of the MWSE layers are preferably in contact with the circumference or the jacket of the slip ring 7 with a slight pressure.

As is shown in FIG. 4, two or more MWSE layers A, B are preferably offset in relation to one another and have different numbers of MWSE 3. For example, three MWSE 3 are arranged next to one another in layer A. The layer B has two MWSE 3. The lateral offset of the layers A, B is such that the multiwire slip rings 2 of one layer A are exactly staggered in relation to the multiwire slip rings 2 of an adjacent layer B. The multiwire slip rings 2 of one layer A, B form a common two- or three-part sliding track on the circumference of a slip ring 7 that is to be brought into contact. The offset of the layers A, B is such that the different sliding tracks of the layers A, B together form a continuous, broad overall sliding track.

The MWSE 3 are connected to the MWSE carrier preferably by welding or riveting in the area of the stepped incisions 5 at the points 11. The carrier leaves 1 are fastened to the respective tangential step sides 5'.

As is shown in FIG. 5, a plurality of brush heads 6 are preferably arranged distributed over the circumference of the slip ring 7. Furthermore, a plurality of brush heads 6 may be arranged next to one another in order to generate additional or broader sliding tracks.

Figure 6:
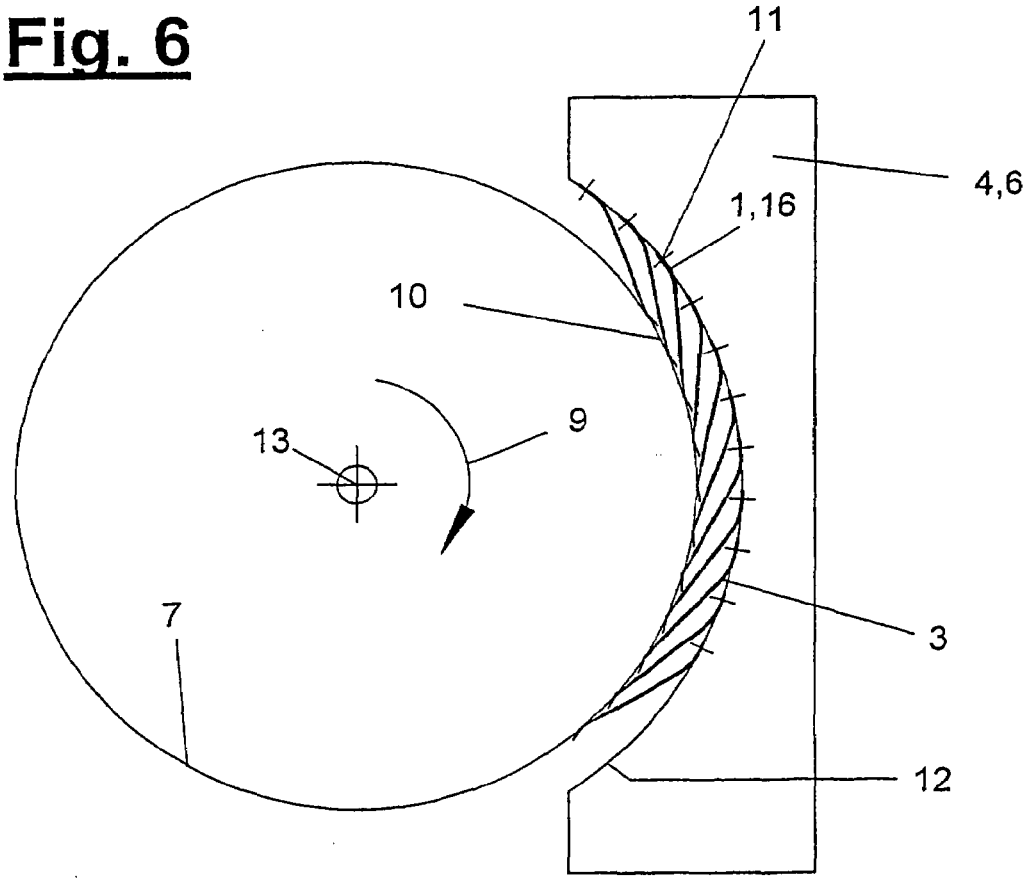
FIG. 6 is a side view of a variant of an MWSE carrier.

FIG. 6 shows a variant of the MWSE carrier 4 and of the shape as well as of the fastening of the individual multiwire sliding elements MWSE 3. The carrier 4 has an essentially smooth inner wall 12 that is concentric with the axis 13 in this embodiment without the stepped incisions present in the previous exemplary embodiment. At their carrier leaves 1, the MWSE 3 have foot parts or foot tabs 16, which are bent on the end side, are in contact with the inner wall 12 in some areas, and are connected thereto in an electrically conductive manner in a suitable manner by welding, soldering, riveting, screwing or the like.

Various variants of the embodiment shown are possible. On the one hand, the number and the arrangement of the brush blocks 6 may vary. On the other hand, the number, distribution and arrangement of the MWSE 3 within the brush blocks 6 may be modified. A disk-shaped design of the slip ring 1 with correspondingly bent brush blocks 6 and with MWSE arranged one after another in an arc is also possible.

While specific embodiments of the invention have been shown and described in detail to illustrate the application of the principles of the invention, it will be understood that the invention may be embodied otherwise without departing from such principles.

The invention claimed is:

1. A brush block for transmitting currents to a slip ring, the brush block comprising:

a brush block body; and a plurality of multiwire sliding elements (MWSEs) connected electrically in parallel and arranged at said brush block body one after another and distributed in an arc in a direction of sliding wherein said MWSEs form MWSE layers, which are arranged in an overlapping, scale-like structure, and describe an enveloping curve that is concentric with an axis of the slip ring with the ends of said MWSE.

2. A brush block in accordance with claim 1, wherein said brush block body has a MWSE carrier with a bent inner wall, at which said plurality of MWSEs are arranged.

3. A brush block in accordance with claim 1, wherein a plurality of said brush blocks can be arranged next to one another and distributed over the circumference of a slip ring.

4. A brush block in accordance with claim 1, wherein each of said MWSEs comprise a conductive carrier leaf with multiwire slip rings arranged thereon.

5. A brush block in accordance with claim 4, wherein said wires of said multiwire slip ring are bent at the free end.

6. A brush block in accordance with claim 4, wherein said wires of said multiwire slip ring are integrated in a one-layer or multilayer paintbrush structure.

7. A brush block for transmitting currents to a slip ring, the brush block comprising:

a brush block body; and a plurality of multiwire sliding elements (MWSEs) connected electrically in parallel and arranged at said brush block body one after another and distributed in an arc in a direction of sliding, wherein said brush block body has a MWSE carrier with a bent inner wall, at which said plurality of MWSEs are arranged and wherein said MWSE carrier has at said inner wall a plurality of stepped incisions which are arranged in an arc on the circumferential side and at which said MWSEs are arranged.

8. A brush block in accordance with claim 7, wherein said stepped incisions have a step side that is essentially tangential to said slip ring and a step side that is arranged at right angles thereto.

9. A brush block in accordance with claim 7, wherein said MWSEs form MWSE layers , which are arranged in an overlapping, scale-like structure, and describe an enveloping curve that is concentric with an axis of the slip ring with the ends of said MWSE.

10. A brush block in accordance with claim 9, wherein said MWSE layers have different numbers of said MWSE.

11. A brush block in accordance with claim 9, wherein said MWSE of said adjacent layers have a lateral offset and are arranged staggered.

12. A rotating current transmission unit comprising:

a slip ring; and a brush block, said slip ring and said brush block being mounted rotatably in relation to one another, said brush block comprising a brush block body and a plurality of multiwire sliding elements connected electrically in parallel and arranged at said brush block body one after another and distributed in an arc in a direction of sliding, wherein said multiwire sliding elements form multiwire sliding element layers, which are arranged in an overlapping, scale-like structure, and describe an enveloping curve that is concentric with an axis of the slip ring.

13. A rotating current transmission unit in accordance with claim 12, wherein said current transmission unit has terminals for power current.

* * * * *

UNITED STATES PATENT AND TRADEMARK OFFICE

CERTIFICATE OF CORRECTION

PATENT NO. : 7,287,985 B2
APPLICATION NO. : 10/567818
DATED : October 30, 2007
INVENTOR(S) : Bülter It is certified that error appears in the above-identified patent and that said Letters Patent is hereby corrected as shown below:

Title page should read

(12) Bülter

(75) Olaf Bülter, Sulzbach (DE)

Signed and Sealed this

Eighteenth Day of March, 2008

JON W. DUDAS
*Director of the United States Patent and Trademark Office*